US011174579B2

(12) United States Patent
Ikadai et al.

(10) Patent No.: US 11,174,579 B2
(45) Date of Patent: Nov. 16, 2021

(54) SINGLE CHAIN STITCH SEWING DEVICE

(71) Applicant: HONDA MOTOR CO., LTD., Tokyo (JP)

(72) Inventors: Yosuke Ikadai, Tochigi-ken (JP); Satoru Iriyama, Tochigi-ken (JP); Toru Takamura, Tochigi-ken (JP)

(73) Assignee: HONDA MOTOR CO., LTD., Tokyo (JP)

( * ) Notice: Subject to any disclaimer, the term of this patent is extended or adjusted under 35 U.S.C. 154(b) by 197 days.

(21) Appl. No.: 16/478,873

(22) PCT Filed: Dec. 26, 2017

(86) PCT No.: PCT/JP2017/046543

§ 371 (c)(1),
(2) Date: Jul. 18, 2019

(87) PCT Pub. No.: WO2018/135251

PCT Pub. Date: Jul. 26, 2018

(65) Prior Publication Data

US 2019/0360141 A1 Nov. 28, 2019

(30) Foreign Application Priority Data

Jan. 20, 2017 (JP) ..... JP2017-008861

(51) Int. Cl.
*D05B 1/06* (2006.01)
*D05B 57/04* (2006.01)
*D05B 73/08* (2006.01)

(52) U.S. Cl.
CPC ..... *D05B 1/06* (2013.01); *D05B 57/04* (2013.01); *D05B 73/08* (2013.01)

(58) Field of Classification Search
CPC ..... D05B 1/00–16; D05B 57/00–06; D05B 57/14; D05B 57/145; D05B 57/30;
(Continued)

(56) References Cited

U.S. PATENT DOCUMENTS 2,860,591 A * 11/1958 Van Ness ..... D05B 57/02 112/201
3,954,070 A * 5/1976 Papajewski ..... D05B 57/14 112/182

(Continued)

FOREIGN PATENT DOCUMENTS

DE 19956396 A1 * 6/2000
GB 580464 A * 9/1946

(Continued)

OTHER PUBLICATIONS

International Search Report and Written Opinion for International Application No. PCT/JP2017/046543 dated Mar. 27, 2018, 8 pages.

*Primary Examiner* — Ismael Izaguirre
(74) *Attorney, Agent, or Firm* — Amin, Turocy & Watson, LLP

(57) ABSTRACT

This single chain stitch sewing device is provided with a sewing mechanism provided on a front end arm of a delivery robot. The sewing mechanism comprises a sewing motor for supplying power to sewing needles and loopers. When the sewing motor is energized, power is transmitted to the sewing needles via a first power transmission mechanism, this causing the sewing needles to move reciprocally. At the same time, power is transmitted to the loopers via a second power transmission mechanism to rotate the loopers. Accordingly, sewing is performed. The loopers are provided at an end of a post bed on the side closer to the sewing needles.

7 Claims, 9 Drawing Sheets

(58) Field of Classification Search
CPC ..... D05B 57/32; D05B 73/08; D05B 73/00; D05B 73/04; D05B 15/00; D05B 15/02
See application file for complete search history.

(56) References Cited

U.S. PATENT DOCUMENTS

| | | | | | |
|---|---|---|---|---|---|
| 4,373,458 | A * | 2/1983 | Dorosz | ..... | D05B 51/00 112/470.06 |
| 4,817,543 | A * | 4/1989 | Fischer | ..... | D05B 21/00 112/220 |
| 5,313,897 | A | 5/1994 | Katamine et al. | | |
| 6,470,815 | B1 * | 10/2002 | Ho | ..... | D05B 3/02 112/260 |
| 2013/0008362 | A1 | 1/2013 | Wenzel et al. | | |

FOREIGN PATENT DOCUMENTS

| | | |
|---|---|---|
| JP | 06-126679 | 5/1994 |
| JP | 5314980 | 10/2013 |
| JP | 2014-520602 | 8/2014 |

* cited by examiner 10
102a
102b
40
12
42
44
46
52
48
50
54
80
24
60
62
56
58
16
28a
28b
59
20a
20b
30
14
22a
90
22b
74
106b
106a
104
72
100
88
94
96
66
86
92
70
82
68
84
76
64

SINGLE CHAIN STITCH SEWING DEVICE

TECHNICAL FIELD

The present invention relates to a single chain stitch sewing device that forms stitches on a workpiece with a needle and a looper.

BACKGROUND ART

For creating an upscale look or high-class feel in an automobile cabin, sewing can be applied (stitches can be formed) on surface material such as genuine leather which has been cut or shaped to the shape of an interior component, such as an instrument panel. Such sewing is conventionally performed by an operator using a stationary sewing machine. In the sewing machine, thread passed through a needle is drawn by a looper which lies opposite the needle across a sewing machine table on which a workpiece to be sewed is placed. As a result, a series of stiches are formed as single chain stitch, as described in Japanese Patent No. 5314980, for instance.

However, manual work with a stationary sewing machine is cumbersome. For addressing this, one possibility is to perform sewing with a sewing operation robot having a sewing machine as a sewing mechanism provided at a tip arm, as described in Japanese Laid-Open Patent Publication No. 06-126679, for instance.

SUMMARY OF INVENTION

An instrument panel includes an area with a small clearance, such as around a meter visor attachment portion. It is difficult for a wide post bed, such as one described in Japanese Laid-Open Patent Publication No. 06-126679, to enter an area corresponding to such a clearance, in the surface material shaped according to the instrument panel.

A primary object of the present invention is to provide a single chain stitch sewing device capable of applying sewing to surface material or the like which has been shaped in a condition capable of being affixed to an interior component.

Another object of the present invention is to provide a single chain stitch sewing device capable of applying sewing to a narrow space.

According to an aspect of the present invention, a single chain stitch sewing device is provided. The single chain stitch sewing device includes a sewing mechanism that includes a needle configured to repeatedly make reciprocating motion to thereby be stuck into and retracted away from a workpiece, and a looper facing the needle across the workpiece, the sewing mechanism being configured to form stitches on the workpiece with the needle and the looper. The sewing mechanism further includes: a power source configured to rotate the looper and simultaneously reciprocate the needle; a crank configured to transmit power of the power source to the needle; a power transmission mechanism that is at least partially housed in a post bed and configured to transmit the power of the power source to the looper; and a first gear and a second gear that are provided in the post bed as constituent elements of the power transmission mechanism and configured to mesh each other. The looper rotates together with the second gear, and is provided at a tip of the post bed that faces the needle.

As described above, the present invention reciprocates the needle and simultaneously rotates the looper with power from the power source. Thus, a loop portion is formed by the thread on the needle being pulled by the looper, and when power from the power source is continuously transmitted to the needle and the looper, a series of the loop portions are formed. As a result, stitches can be formed automatically and continuously.

In addition, disposing the looper at a tip of the post bed allows the post bed to be constructed with a narrow width. Accordingly, entry of the post bed into a narrow space in a workpiece is facilitated. As will be appreciated from this, sewing of a portion where a narrow space such as a clearance is formed can be performed automatically and continuously even when the workpiece is surface material shaped according to an interior component such as an instrument panel, for example.

Moreover, a bobbin for lower thread and the like are not necessary since the present device is directed to single chain stitch, not lock stitch. Owing to this, it is possible to further reduce the width of the post bed.

Preferably, a power transmission shaft is interposed between the crank and the power source. In this case, the needle and the power source are relatively largely spaced from each other. Accordingly, interference of the power source with the workpiece or the like can be avoided when the post bed (the looper) is made to enter a narrow space.

There may be two needles and two loopers. In this case, aesthetically appealing parallel stitches can be formed. In such a configuration, the second gear may be interposed between the two loopers. This can make the separation distance between the two loopers small and hence an assembly including the two loopers and the second gear can be constructed as a compact assembly.

When two needles are placed in parallel such that their needle grooves face in the same orientation, a thread hooking portion of one of the two loopers will face inward. Consequently, it can be difficult to locate a gear and the like between the two loopers. For such a configuration, it is conceivable to position the gear and the like outwardly of the loopers. In this case, however, the post bed would be wide and thus insertion of the post bed into a narrow clearance would not be easy. As a result, workpieces to which sewing can be applied are limited.

For avoidance of such a disadvantage, in a case where each of the two needles is provided with a needle groove, it is preferable that the back sides of the needle grooves face each other and that a thread hooking portion of each of the two rotating loopers passes through the corresponding needle groove. In this case, the two loopers are in a relationship of mirror symmetry, with their thread hooking portions facing outward away from each other. Because the needle grooves are of a shape formed by cutting away part of a side wall of the needle and the thick thread hooking portions face outward, a gear and the like can be disposed between the loopers. Also, by having the thread hooking portion of each looper pass through the needle groove, the two loopers can be placed further closer to each other. For these reasons, the post bed can be made further narrow.

The power transmission mechanism may include a timing belt and gear train, for example. This can make the distance between the loopers and the power source relatively large. That is, it becomes easier to avoid interference of the power source with the workpiece when the post bed is made to enter a narrow space.

In the above configuration, a transfer mechanism for transferring the sewing mechanism is preferably provided. In this case, it is easy to move the workpiece relatively to the needles during sewing. Accordingly, it becomes easier to perform sewing automatically and continuously. Also, by changing the posture of the sewing mechanism under the action of the transfer mechanism, sewing can be easily performed on workpieces of various shapes.

With the present invention, the needle is reciprocated and simultaneously the looper is rotated under the action of the power source. Thus, stitches can be formed automatically and continuously by continuous transmission of power from the power source to the needle and the looper.

In addition, disposing the looper at a tip of the post bed allows the post bed to be constructed with a narrow width. Accordingly, entry of the post bed into a narrow space is facilitated. This enables sewing of a portion where the narrow space is formed, and it is thus possible to automatically and continuously perform sewing even on a workpiece with a clearance of a narrow width or the like formed thereon.

DESCRIPTION OF EMBODIMENTS

Figure 1:
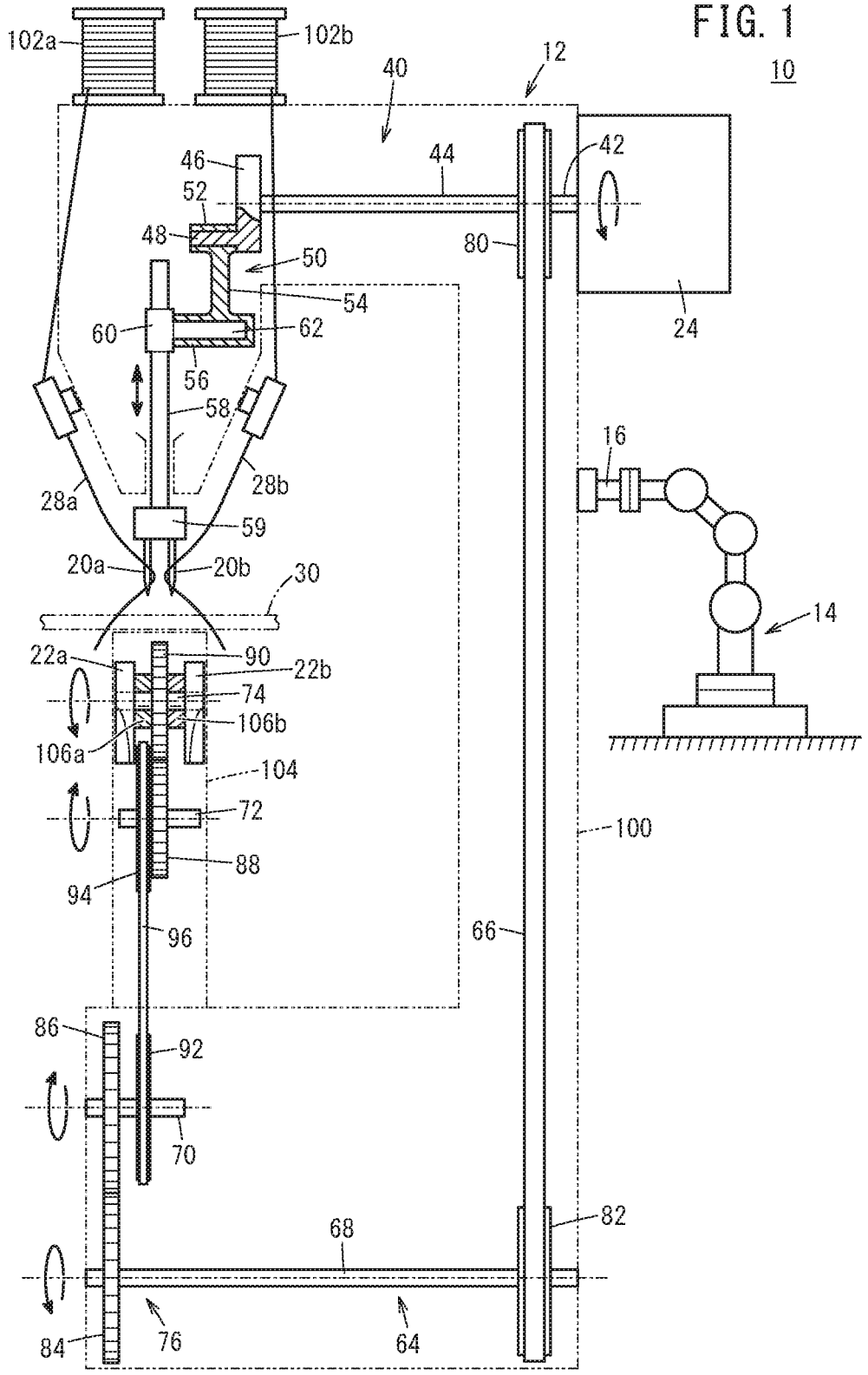
FIG. 1 is a schematic diagram describing a configuration of relevant parts of a single chain stitch sewing device according to an embodiment of the present invention.

The single chain stitch sewing device according to the present invention is described in detail below by showing preferred embodiments and with reference to the accompanying drawings. The terms "down/lower", "up/upper", "left", and "right" used hereinbelow correspond to the downward, upward, leftward, and rightward directions in the drawings, respectively; however, they just indicate directions for the sake of convenience in order to facilitate understanding and do not define the directions in the actual use of the single chain stitch sewing device.

FIG. 1 is a schematic diagram describing a configuration of relevant parts of a single chain stitch sewing device (hereinafter, also referred to just as "sewing device") 10 according to an embodiment. The sewing device 10 includes a sewing mechanism 12, and a transfer robot 14 as a transfer mechanism for transferring the sewing mechanism 12. The sewing mechanism 12 is provided at a tip arm 16 of the transfer robot 14. In FIG. 1, the sewing mechanism 12 is shown enlarged and exaggerated.

The sewing mechanism 12 is described in greater detail chiefly with reference to FIG. 1. In this example, the sewing mechanism 12 includes two sewing machine needles 20*a*, 20*b* (needles), two loopers 22*a*, 22*b* arranged so as to face the sewing machine needles 20*a*, 20*b*, and a sewing motor 24 as a power source for supplying power to the sewing machine needles 20*a*, 20*b* and the loopers 22*a*, 22*b*. The sewing machine needles 20*a*, 20*b* each have an insertion hole 26 (see FIG. 2) formed therein, and sewing threads 28*a*, 28*b* are inserted into the respective insertion holes 26. On a workpiece 30 inserted between the sewing machine needles 20*a*, 20*b* and the loopers 22*a*, 22*b*, parallel stitches 32 (see FIG. 8) are formed with the sewing threads 28*a*, 28*b*.

The power of the sewing motor 24 is transmitted to the sewing machine needles 20*a*, 20*b* through a first power transmission mechanism 40. Specifically, a driving shaft 42 of the sewing motor 24 is connected with the right end of a long first driven shaft 44 (power transmission shaft). A rotary disk 46 as a constituent element of a crank is externally fitted on the left end of the first driven shaft 44.

A first shank 48, which is a protrusion of a substantially cylindrical shape, is formed on the rotary disk 46 midway from the center of the rotary disk 46 to its outer periphery along a radial direction. The first shank 48 is inserted into a hollow interior of a second shank 52, which is a constituent element of a crank arm 50. In addition to the second shank 52, the crank arm 50 has a plate-shaped connecting arm portion 54 projecting from a side wall of the second shank 52, and a third shank 56 connected with the connecting arm portion 54 and extending in parallel to the second shank 52. The third shank 56 extends in parallel to the second shank 52.

Meanwhile, the sewing machine needles 20*a*, 20*b* are held by a needle holder 59 provided at a lower end of a reciprocating shaft 58 which extends along a vertical direction. A shank-equipped ring 60 is externally fitted on the upper end of the reciprocating shaft 58, and a fourth shank 62 of the shank-equipped ring 60 is inserted into a hollow interior of the third shank 56. As a result, the sewing machine needles 20*a*, 20*b* are connected to the first driven shaft 44 via the crank arm 50 (crank), the reciprocating shaft 58, and the needle holder 59. Thus, when the sewing motor 24 is energized so that the first driven shaft 44 is driven to rotate, rotary motion is converted into linear motion under the action of the crank arm 50, thereby causing the sewing machine needles 20*a*, 20*b* to reciprocate along the vertical direction.

Meanwhile, the power of the sewing motor 24 is transmitted to the loopers 22*a*, 22*b* through a second power transmission mechanism 64. The second power transmission mechanism 64 includes a second driven shaft 68, a third driven shaft 70, a fourth driven shaft 72, and a fifth driven shaft 74, which are driven to rotate following the driven rotation of the first driven shaft 44 under the action of a first timing belt 66, and also includes a gear train 76 arranged on an area from the second driven shaft 68 to the fifth driven shaft 74. As will be appreciated from this, the first driven shaft 44 is not only a constituent element of the first power transmission mechanism 40 but also a constituent element of the second power transmission mechanism 64.

A first pulley 80 is externally fitted near an end of the first driven shaft 44 that is positioned closer to the driving shaft 42 (the right end), while a second pulley 82 is externally fitted on the right end of the second driven shaft 68, which is long. The first timing belt 66 is wound on the first pulley 80 and the second pulley 82. A first driven gear 84 is externally fitted on the left end of the second driven shaft 68.

The first driven gear 84 meshes with a second driven gear 86 externally fitted on the left end of the third driven shaft 70, which is relatively short. The first driven gear 84 and the second driven gear 86, and a third driven gear 88 and a fourth driven gear 90, which are described later, constitute the gear train 76.

On the third driven shaft 70, a third pulley 92 is disposed to the right of the second driven gear 86. Also, a fourth pulley 94 is externally fitted near the left end of the fourth driven shaft 72, which is positioned above the third driven shaft 70 and has the substantially same length as the third driven shaft 70. On the third pulley 92 and the fourth pulley 94, a second timing belt 96 shorter than the first timing belt 66 is wound.

The third driven gear 88 (a first gear) is disposed substantially in the middle of the fourth driven shaft 72 in a longitudinal direction. Further, the fourth driven gear 90 (a second gear) meshes with the third driven gear 88. The fourth driven gear 90 is located between the loopers 22*a*, 22*b*. In other words, the loopers 22*a*, 22*b* are at positions interposing the fourth driven gear 90 therebetween. The looper 22*a*, the fourth driven gear 90, and the looper 22*b* are supported on the fifth driven shaft 74, so that they integrally rotate following the rotation of the fifth driven shaft 74.

Figure 3:
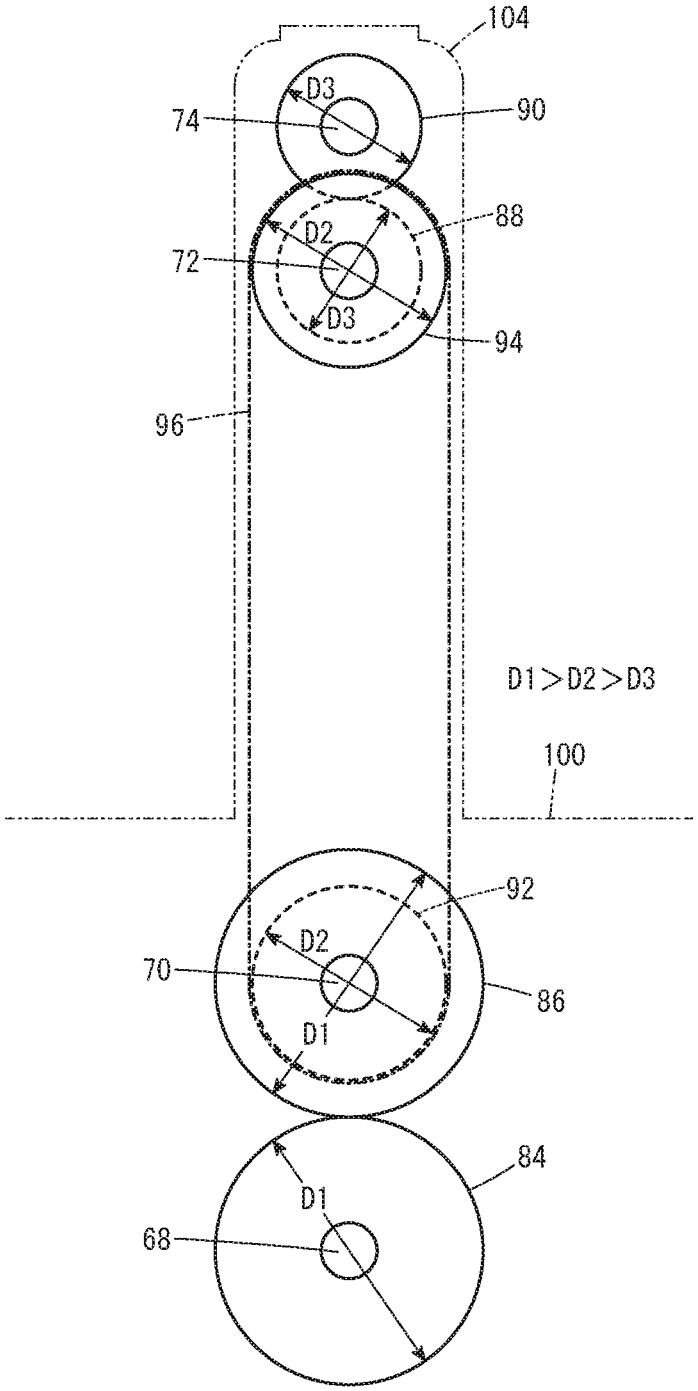
FIG. 3 is a schematic side view of relevant parts showing a relationship between a diameter D1 of a first driven gear and a second driven gear, a diameter D2 of a third pulley and a fourth pulley, and a diameter D3 of a third driven gear and fourth driven gear.

In the above configuration, the first driven gear 84 and the second driven gear 86 are equal in diameter. Also, the third pulley 92 and the fourth pulley 94 are equal in diameter, and further the third driven gear 88 and the fourth driven gear 90 are equal in diameter. Then, as shown in FIG. 3, the relationship of D1>D2>D3 is satisfied where D1 is the diameters of the first driven gear 84 and the second driven gear 86, D2 is the diameters of the third pulley 92 and the fourth pulley 94, and D3 is the diameters of the third driven gear 88 and the fourth driven gear 90.

As shown in FIG. 1, the first power transmission mechanism 40 is housed in a casing 100. The sewing motor 24 is positioned on and fixed to the casing 100, and the second driven shaft 68 and the third driven shaft 70 are rotatably supported to the casing 100. Bobbins 102*a*, 102*b* are rotatably supported on the upper end of the casing 100, and the sewing threads 28*a*, 28*b* are reeled out from the bobbins 102*a*, 102*b* and then inserted into the insertion holes 26 of the sewing machine needles 20*a*, 20*b*, respectively (see FIG. 2).

Figure 2:
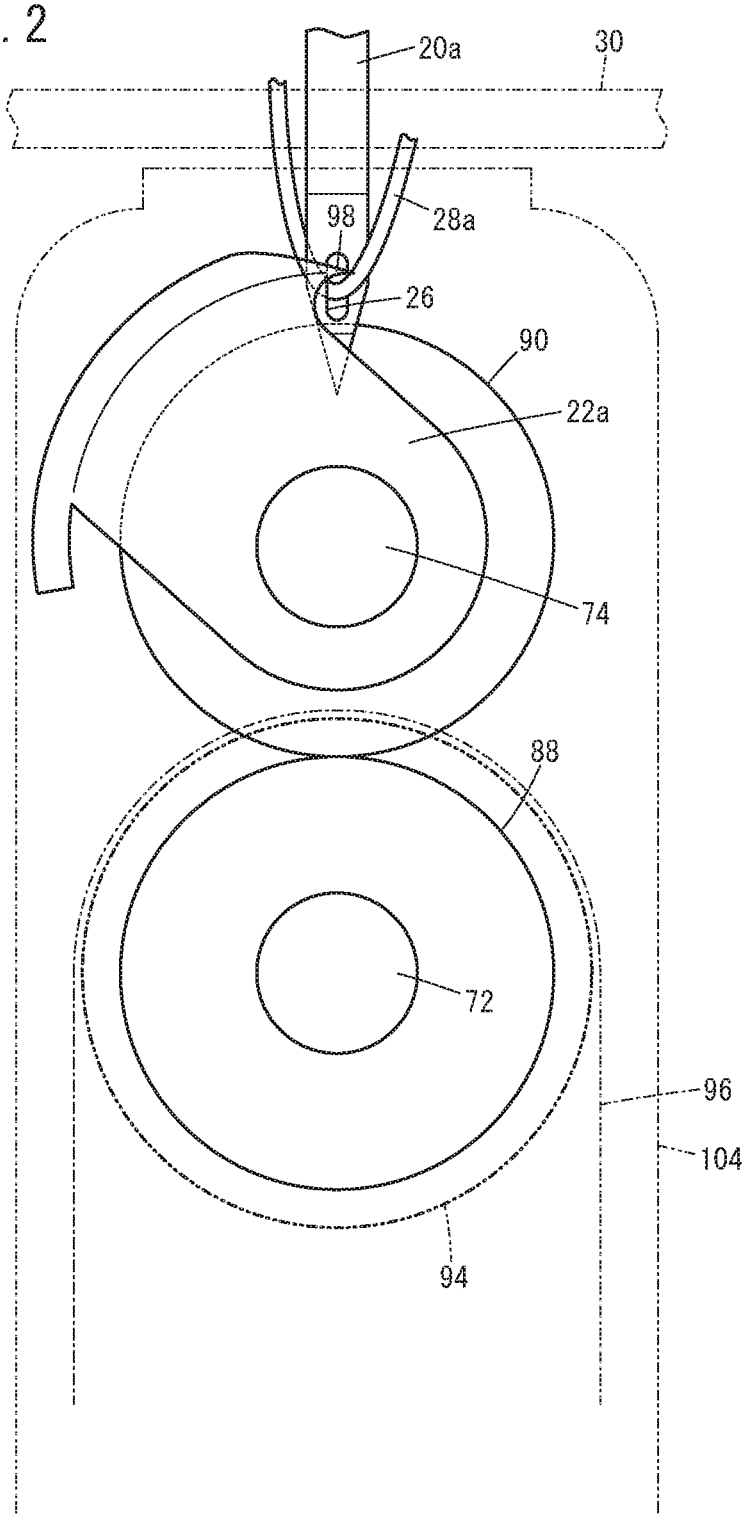
FIG. 2 is an enlarged side view of relevant parts showing an area around a needle and a looper of the single chain stitch sewing device of FIG. 1.
Figure 4:
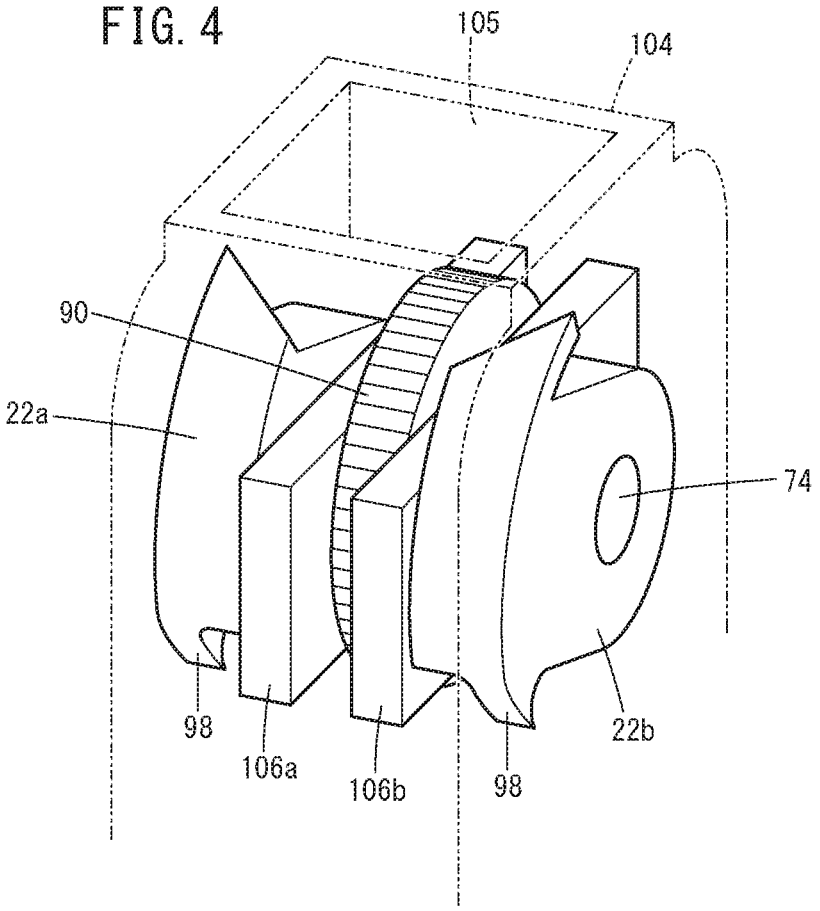
FIG. 4 is a schematic perspective view of relevant parts showing an area around the fourth driven gear and bearings.

A hollow post bed 104, which is formed into a vertically long shape and is narrow in width, is provided at the left end of the casing 100, that is, above the first driven gear 84 and the second driven gear 86. The post bed 104 houses therein the second power transmission mechanism 64, that is, a most part of the second timing belt 96, the fourth driven shaft 72, the fourth pulley 94, the third driven gear 88, the fifth driven shaft 74, and the fourth driven gear 90, as well as the loopers 22*a*, 22*b*. As shown in FIGS. 2 to 4, the upper end of the post bed 104 is curved such that it is somewhat thinned down, and its uppermost portion forms a flat placement portion. This placement portion has an opening 105 (see FIG. 4) through which the sewing machine needles 20*a*, 20*b* can be advanced into and retracted from the hollow interior of the post bed 104.

A portion of the second timing belt 96 that is wound on the third pulley 92 is covered by the casing 100, while the other portion of the second timing belt 96 is covered by the post bed 104. The fourth driven shaft 72 is rotatably supported on the post bed 104, and the fifth driven shaft 74 is rotatably supported on a pair of bearings 106*a*, 106*b*, which are integral with inner walls of the post bed 104. The fourth driven gear 90 is disposed between the pair of bearings 106*a*, 106*b* as shown in FIGS. 2 and 4. The loopers 22*a*, 22*b* are only supported by the fifth driven shaft 74 and they are not in contact with either of the fourth driven gear 90 or inner walls of the post bed 104.

The loopers 22*a*, 22*b* each have a sharp claw 98 (a thread hooking portion) provided on an outward portion of the looper 22*a*, 22*b* in the width direction so as to project along the direction of rotation. The loopers 22*a*, 22*b* each rotate with the claw 98 taking the lead in the rotation. In the rotation, when the tips of the sewing machine needles 20*a*, 20*b* are stuck from one end face of the workpiece 30 and then protrude from the other end face side, the claws 98 hook or catch the sewing threads 28*a*, 28*b*.

Figure 5:
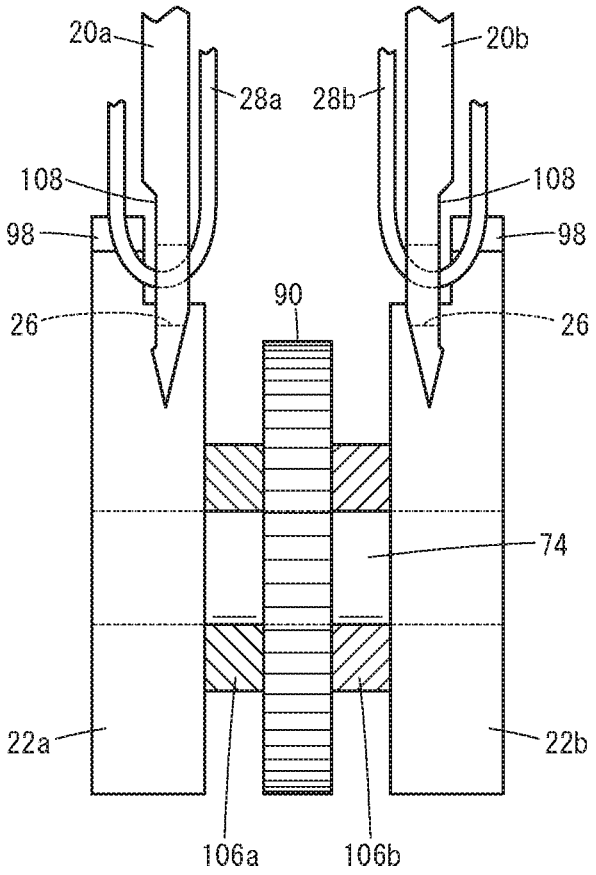
FIG. 5 is a schematic front view of relevant parts showing a positional relationship between loopers and needles with needle grooves formed therein.

As shown in FIG. 5, which omits the illustration of the post bed 104, each of the sewing machine needles 20*a*, 20*b* has one needle groove 108 formed therein. The sewing machine needles 20*a*, 20*b* are held by the needle holder 59 such that the back sides of the needle grooves 108 face each other. That is, when the sewing machine needles 20*a*, 20*b* enter the post bed 104, each needle groove 108 faces outward in the width direction of the post bed 104. When the loopers 22*a*, 22*b* rotate, the claws 98 pass through the respective needle grooves 108.

In the above configuration, the transfer robot 14 and the sewing motor 24 operate under the control and action of a control circuit, not illustrated.

The sewing device 10 according to the embodiment is basically configured as described above. Next, its actions and effects are described in relation to the operation of the sewing device 10.

When sewing is performed on the workpiece 30, the transfer robot 14 operates as appropriate under the control and action of the control circuit, such that the tip arm 16 thereof approaches the workpiece 30 and places the workpiece 30 at a position where the workpiece 30 sits between the post bed 104 (the loopers 22*a*, 22*b*) and the sewing machine needles 20*a*, 20*b*. That is, the loopers 22*a*, 22*b* face the sewing machine needles 20*a*, 20*b* across the workpiece 30. In this way, provision of the transfer robot 14 for transferring the sewing mechanism 12 facilitates transferring the sewing mechanism 12 close to the workpiece 30. The sewing threads 28*a*, 28*b* are inserted beforehand in the respective insertion holes 26 of the sewing machine needles 20*a*, 20*b*.

Figure 6:
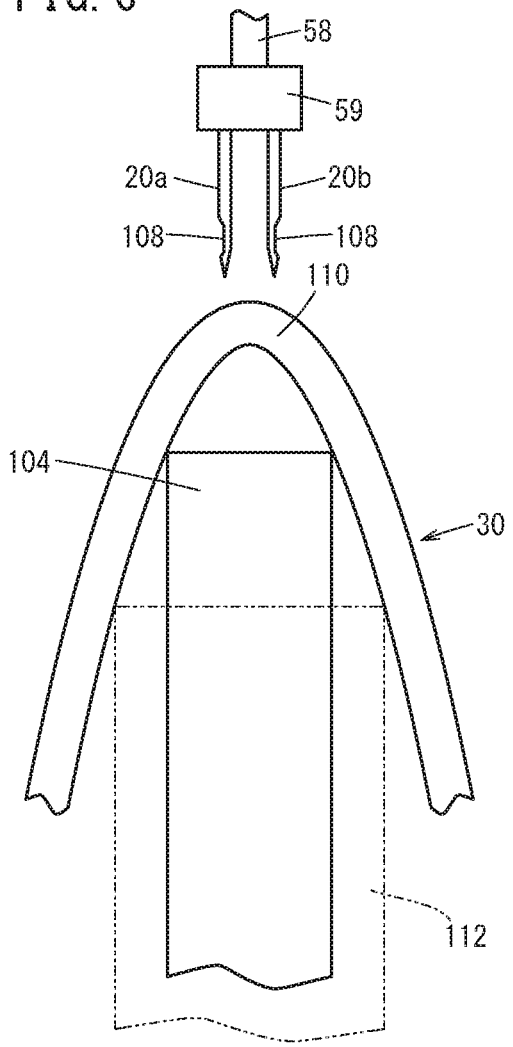
FIG. 6 is a schematic front view of relevant parts showing a situation where a post bed having the looper of FIG. 2 at its tip enters a bent portion of a workpiece.

As shown in FIG. 6, the workpiece 30 sometimes has a bent portion 110 bent at an acute angle. In this case, a wide post bed 112 as shown by the phantom line cannot enter the tip of such a bent portion 110. By contrast, in this embodiment, the fourth driven gear 90 is sandwiched between the two loopers 22*a*, 22*b*, and they are supported by the single fifth driven shaft 74 as described above. Thus, an assembly containing the loopers 22*a*, 22*b*, the fourth driven gear 90, and the fifth driven shaft 74 can be made compact. Accordingly, the post bed 104 having the assembly at its tip can be constructed to be vertically long and narrow in width, thereby enabling the post bed 104 to enter deep into the acute-angled bent portion 110.

Moreover, since the first driven shaft 44, the crank arm 50, and the like are located between the sewing motor 24 and the sewing machine needles 20*a*, 20*b*, the sewing motor 24 is relatively largely spaced from the sewing machine needles 20*a*, 20*b*. This avoids interference of the sewing motor 24 with the workpiece 30 when the post bed 104 is made to enter a narrow space such as the bent portion 110.

That is to say, according to this embodiment, the post bed 104 and the loopers 22*a*, 22*b* can enter even a narrow space. Thus, sewing is possible even if the acute-angled bent portion 110, a stepped portion, or the like is formed on the workpiece 30, that is, even in a case where the workpiece 30 is surface material of a shape corresponding to the shape of an interior component for an automobile instrument panel, for example.

Next, the control circuit activates the sewing motor 24. This causes the driving shaft 42 and the first driven shaft 44 to rotate, following which the rotary disk 46 rotates and the first shank 48 provided on the rotary disk 46 turns. As a result, the crank arm 50 turns, along with which the fourth shank 62 of the shank-equipped ring 60 is pulled by the third shank 56 of the crank arm 50. Thus, the reciprocating shaft 58 makes one up-and-down reciprocation in synchronization with one rotation of the rotary disk 46. Of course, the sewing machine needles 20*a*, 20*b* held by the needle holder 59 also makes one up-and-down reciprocation simultaneously with the reciprocating shaft 58.

The first pulley 80 also rotates simultaneously with the rotation of the driving shaft 42 and the first driven shaft 44. This causes circulation of the first timing belt 66 wound on the first pulley 80 and the second pulley 82, which results in the driven rotation of the second driven shaft 68 and the first driven gear 84. Further, the second driven gear 86 meshing with the first driven gear 84, the third driven shaft 70 on which the second driven gear 86 is externally fitted, and the third pulley 92 are driven to rotate, following which the second timing belt 96 wound on the third pulley 92 and the fourth pulley 94 circulates.

In response, the fourth pulley 94, the fourth driven shaft 72, and the third driven gear 88 are driven to rotate. As the third driven gear 88 meshes with the fourth driven gear 90, the fourth driven gear 90 is driven to rotate. Thus, eventually the fifth driven shaft 74 and the loopers 22*a*, 22*b* rotate together. Of course, the loopers 22*a*, 22*b* rotate in synchronization with each other. The loopers 22*a*, 22*b* make one rotation while the sewing machine needles 20*a*, 20*b* make one reciprocation.

Here, the relationship of D1>D2>D3 is satisfied where the diameter D1 of the first driven gear 84 and the second driven gear 86, the diameter D2 of the third pulley 92 and the fourth pulley 94, and the diameter D3 of the third driven gear 88 and the fourth driven gear 90. That is, the diameters of the rotating components become smaller as they are closer to the sewing machine needles 20*a*, 20*b*. This also contributes to the narrowed tip of the post bed 104.

Additionally, in this embodiment, the claw 98 of each of the rotating loopers 22*a*, 22*b* passes through the needle groove 108 during the reciprocating motion of the sewing machine needles 20*a*, 20*b* described above (see FIG. 5). This can make the distance between the loopers 22*a*, 22*b* correspondingly shorter, and it is thus possible to facilitate further narrowing of the tip of the post bed 104.

The sewing machine needles 20*a*, 20*b* are stuck or inserted from the upper end face side of the workpiece 30 while they travel downward along a forward path from a receding end (upper dead point), and upon reaching an advancing end (lower dead point), their tips protrude from the lower end face of the workpiece 30 and enter the hollow interior of the post bed 104 through the opening 105. Along with this, the sewing threads 28*a*, 28*b* penetrate the workpiece 30. After that, the sewing machine needles 20*a*, 20*b* travel upward along a return path from the lower dead point toward the upper dead point, during which they are retracted away from the post bed 104 and the workpiece 30.

Figure 7:
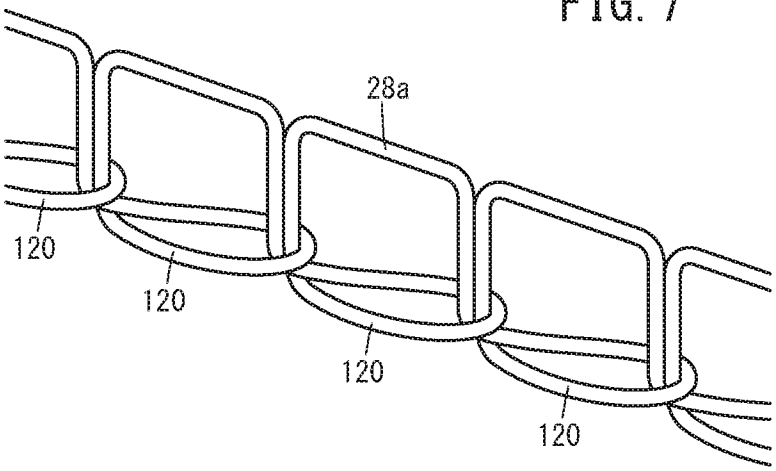
FIG. 7 is a schematic perspective view of relevant parts showing a series of loop portions formed by the needle and the looper of FIG. 2.

When the sewing threads 28*a*, 28*b* have penetrated the workpiece 30, the claws 98 of the loopers 22*a*, 22*b* reach their upper dead point. After penetrating the workpiece 30, the sewing threads 28*a*, 28*b* are caught on the claws 98 and pulled in the downward direction in FIGS. 1 and 2 by the rotation of the loopers 22*a*, 22*b*, thus forming loop portions 120 on the lower end face side of the workpiece 30 as shown in FIG. 7. Into each loop portion 120, a portion of the sewing threads 28*a*, 28*b* that is pulled next time the sewing machine needles 20*a*, 20*b* are stuck (at the next rotation of the loopers 22*a*, 22*b*) is inserted. By repeating the reciprocating motion of the sewing machine needles 20*a*, 20*b* and rotation of the loopers 22*a*, 22*b* while moving the sewing mechanism 12 relatively in parallel to the workpiece 30 via an appropriate operation of the transfer robot 14, the loop portions 120 become joined together so that sewing is done as shown in FIG. 7. Although FIG. 7 illustrates only the sewing thread 28*a*, a series of the loop portions 120 are also formed in a similar manner by the remaining sewing thread 28*b*.

Figure 8:
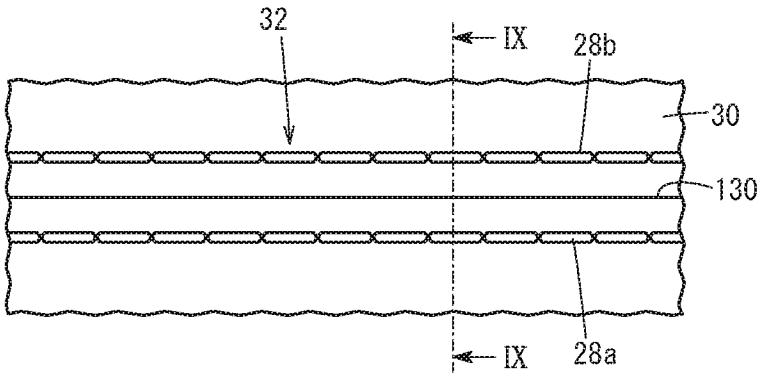
FIG. 8 is a plan view of relevant parts showing parallel stitches formed by the single chain stitch sewing device of FIG. 1.
Figure 9:
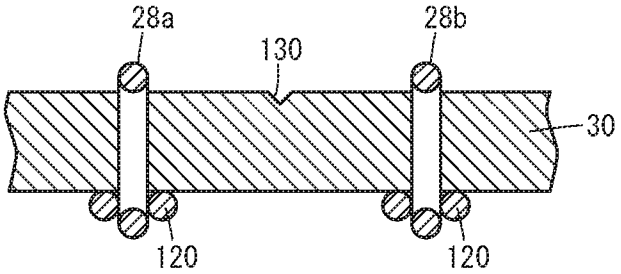
FIG. 9 is a cross-sectional view seen from the arrows at line IX-IX in FIG. 8.

Meanwhile, parallel stitches 32 serially extending in a straight fashion are formed on the upper end face side of the workpiece 30 as shown in FIGS. 8 and 9. In this embodiment, since the two sewing machine needles 20*a*, 20*b* make reciprocating motion in synchronization with each other, aesthetically appealing parallel stitches 32 can be produced. The sewing threads 28*a*, 28*b* forming the parallel stitches 32 are separated from each other with a shaping line 130 in between.

As described, in this embodiment, the sewing machine needles 20*a*, 20*b* are reciprocated and simultaneously the loopers 22*a*, 22*b* are rotated under the action of the sewing motor 24. Besides, since the workpiece 30 moves relatively to the sewing mechanism 12, the parallel stitches 32 can be formed automatically and continuously.

When the control circuit detects that the parallel stitches 32 of a predetermined length have been formed, the sewing motor 24 is deactivated under the control and action of the control circuit. Accordingly, the reciprocating motion of the sewing machine needles 20*a*, 20*b* and the rotation of the loopers 22*a*, 22*b* stop. After the sewing threads 28*a*, 28*b* are cut at a portion between the workpiece 30 and the sewing machine needles 20*a*, 20*b*, the transfer robot 14 operates appropriately to thereby separate the sewing mechanism 12 from the workpiece 30. In this case also, the sewing mechanism 12 is transferred from near the workpiece 30 under the action of the transfer robot 14, and it is thus possible to transfer the sewing mechanism 12 easily.

For sewing a workpiece of a different shape than that of the workpiece 30, the transfer robot 14 may be taught to operate in accordance with the shape of the workpiece. In this way, provision of the transfer robot 14 allows sewing to be done on workpieces of various shapes.

The present invention is not specifically limited to the above-described embodiment, and may be subjected to various modifications without departing from the scope of the invention.

For example, there may be provided one sewing machine needle 20*a*, 20*b* and one looper 22*a*, 22*b*.

Also, the workpiece 30 is not limited to an interior component and surface material for an automobile instrument panel but may be any component or item that allows the sewing machine needles 20*a*, 20*b* to be stuck thereinto.

DESCRIPTIONS OF REFERENCE NUMERALS

10: single chain stitch sewing device,
12: sewing mechanism,
14: transfer robot,
20*a*, 20*b*: sewing machine needle,
22*a*, 22*b*: looper,

24: sewing motor,
28*a*, 28*b*: sewing thread,
30: workpiece,
32: parallel stitches,
40, 64: power transmission mechanism,
44, 68, 70, 72, 74: driven shaft,
50: crank arm,
58: reciprocating shaft,
59: needle holder,
66, 96: timing belt,
76: gear train,
84, 86, 88, 90: driven gear,
98: claw,
100: casing,
104, 112: post bed,
110: bent portion,
120: loop portion,

What is claim is:

1. A single chain stitch sewing device comprising:

a sewing mechanism that includes a needle configured to repeatedly make reciprocating motion to thereby be stuck into and retracted away from a workpiece, and a looper facing the needle across the workpiece, the sewing mechanism being configured to form stitches on the workpiece with the needle and the looper, wherein the sewing mechanism further includes:

a power source configured to rotate the looper and simultaneously reciprocate the needle;

a crank configured to transmit power of the power source to the needle;

a power transmission mechanism that is at least partially housed in a post bed and configured to transmit the power of the power source to the looper; and a first gear and a second gear that are provided in the post bed as constituent elements of the power transmission mechanism and configured to mesh with each other, and the looper rotates together with the second gear and is provided at a tip of the post bed that faces the needle, wherein the needle comprises two needles, and the looper comprises two loopers; and the second gear is located between the two loopers.

2. The single chain stitch sewing device according to claim 1, wherein a power transmission shaft is interposed between the crank and the power source.

3. The single chain stitch sewing device according to claim 1, wherein each of the two needles is provided with a needle groove, and back sides of the needle grooves of the two needles face each other; and the two loopers have respective thread hooking portions, and the thread hooking portions pass through the respective needle grooves when the two loopers rotate.

4. The single chain stitch sewing device according to claim 1, wherein the power transmission mechanism includes a timing belt and a gear train.

5. The single chain stitch sewing device according to claim 1, further comprising a transfer mechanism configured to transfer the sewing mechanism.

6. The single chain stitch sewing device according to claim 1, wherein the crank converts rotary motion generated by the power source into linear motion of the needle.

7. A single chain stitch sewing device comprising:

a sewing mechanism that includes a needle configured to repeatedly make reciprocating motion to thereby be stuck into and retracted away from a workpiece, and a looper facing the needle across the workpiece, the sewing mechanism being configured to form stitches on the workpiece with the needle and the looper, wherein the sewing mechanism further includes:

a power source configured to rotate the looper and simultaneously reciprocate the needle;

a crank configured to transmit power of the power source to the needle;

a hollow post bed that extends in a direction in which the needle extends, and the hollow post bed is formed with, at a position facing the needle, an opening through which the needle is advanced;

a power transmission mechanism that is at least partially housed in the post bed and configured to transmit the power of the power source to the looper;

a first gear and a second gear that are provided in the post bed as constituent elements of the power transmission mechanism, are positioned in the direction in which the post bed extends, and are configured to mesh with each other; and a shaft member provided with the second gear and the looper, and the looper rotates together with the second gear and the shaft member and is provided at a tip of the post bed that faces the needle.

* * * * *